United States Patent [19]

Rairden, III

[11] Patent Number: 4,683,148

[45] Date of Patent: Jul. 28, 1987

[54] METHOD OF PRODUCING HIGH QUALITY PLASMA SPRAY DEPOSITS OF COMPLEX GEOMETRY

[75] Inventor: John R. Rairden, III, Schenectady, N.Y.

[73] Assignee: General Electric Company, Schenectady, N.Y.

[21] Appl. No.: 859,536

[22] Filed: May 5, 1986

[51] Int. Cl.[4] ..... C23C 15/00

[52] U.S. Cl. ..... 427/34; 204/164

[58] Field of Search ..... 427/34; 204/164; 219/121 PY

[56] References Cited

U.S. PATENT DOCUMENTS

| | | | |
|---|---|---|---|
| 3,140,380 | 7/1964 | Jensen | 427/34 |
| 3,283,117 | 11/1966 | Holmes et al. | 427/34 |
| 4,492,845 | 1/1985 | Kljuchko et al. | 427/34 |

*Primary Examiner*—John F. Niebling

*Attorney, Agent, or Firm*—Paul E. Rochford; James C. Davis, Jr.; Paul R. Webb, II

[57] ABSTRACT

Dense layers of metals and compounds may be formed on a receiving surface of complex geometry by use of a plasma spray technique in a vacuum chamber in which multiple guns are used simultaneously to deposit material confronting areas.

6 Claims, 11 Drawing Figures

DATA SHOWN: % DENSITY AS-DEPOSITED / % DENSITY AFTER HEAT TREATMENT (2hr, 1250°C)

DATA SHOWN: % DENSITY AS-DEPOSITED / % DENSITY AFTER HEAT TREATMENT (2hr, 1250°C)

METHOD OF PRODUCING HIGH QUALITY PLASMA SPRAY DEPOSITS OF COMPLEX GEOMETRY

RELATED APPLICATIONS

This application relates to copending application Ser. No. 859,537 filed simultaneously herewith. The text of this copending application is incorporated by reference.

BACKGROUND OF THE INVENTION

The present invention relates to a method and means for forming dense articles and articles of irregular configuration by plasma deposition. More particularly it relates to a low pressure plasma deposition process and apparatus by which dense cohesive deposits which have intricate shapes are formed on larger size receiving surfaces. By larger size as the term is used herein is meant a size substantially larger than the area of a receiving surface which is coated with dense deposit as a single stationary plasma gun applies a low pressure plasma deposited layer onto a stationary receiving surface.

The state of the art of low pressure plasma deposition makes possible the deposit of a dense layer in the central portion of the target area within the sweep of a plasma flame. For a particular apparatus and set of operating parameters this central region will be approximately 20 to 40 sq. cm. in diameter and the deposit densities approach about 100% particularly if the deposited layer is given a densification heat treatment. Also typically the spray deposit surrounding the central region, and particularly in a fringe region, is less dense and in fact becomes extremely porous outside an area of about 100 sq. cm. The porous outer zone is not densified to even 97% of theoretical density and material with density of less than 97% has poor combinations of physical properties, and in particular poor tensile properties.

One reason why a deposit at its outer fringes is less dense and in other respects has less desirable properties is that the angle of incidence of the deposit from the gun is not at right angles or at 90°. It has been found that deposit from a plasma flame which is incident on a receiving surface at an acute angle substantially different from 90° has poorer properties. Also the properties deteriorate more the more the angle is different from 90°.

To put this in perspective and using circular areas a designated central area of dense deposit of 20 square centimeters covers an area having a diameter of about 5 centimeters. If only the central area is dense as deposited then only a small fraction of the whole deposit is dense. 40 square centimeters is included within a circle having a diameter of about 7.1 centimeters and the 100 square centimeter area is included within a circle having a diameter of about 11.3 centimeters.

Under present technology if the size of the deposit to be made from a plasma gun is larger in at least one dimension than the dense region of a spray pattern, then it is necessary to use either a gun motion or substrate motion, or both, to cover the larger area. This motion leads to a deposit that is some combination of dense and porous. The effect of increasing the deposit size on the tensile and ductility properties of the deposit leads to the conclusion that larger area deposits are less dense and are weaker in the as-deposited state.

Also, in general where the deposition angle (meaning the acute angle between the direction of the spray and the surface on which the spray is deposited) is low then the density and tensile properties of the deposit are further reduced. For example, if the deposition angle is less than 70° this leads to a further reduction in density and tensile properties of the deposit over those found for the layers deposited with the gun aimed normal to the receiving surface.

Where the receiving surface itself is non-planar, and particularly when the surface has a complex geometry, these parts of the surface which are not aimed normal to the plasma gun will receive the plasma spray at angles other than the desirable 90° which leads to the high density deposit.

Plasma spray deposits have been formed from numerous powdered starting materials including powders of nickel base superalloys.

It has been found that the ductility values of deposits which have less than a 97% density after heat treatment, as, for example, at about 1250° for nickel base superalloys for a suitable time, is low.

SUMMARY OF THE INVENTION

Accordingly one object of the present invention is to provide a method by which convoluted dense surface coatings can be made through low pressure plasma deposition with good properties in the as deposited layer.

Another object is to provide a method of forming a more uniform deposit on more intricately shaped three dimensional surfaces.

Another object is to provide an apparatus which permits dense deposits to be made over irregular areas through low pressure plasma deposition techniques.

Another object is to provide a method by which dense deposits can be made on a surface of complex geometry of relatively large dimensions.

Still another object is to provide more uniformly dense deposits made by low pressure plasma deposition techniques over a relatively large area of an irregularly shaped surface.

Other objects will be in part apparent and in part pointed out in the description which follows.

In one of its broader aspects the objects of the invention may be achieved by providing at least two guns in a low pressure plasma spray chamber and depositing material simultaneously from the guns in patterns which overlap as the deposit is being made. The two guns are mounted in the chamber to provide a trajectory for the plasma flame which is incident on a receiving surface in an overlapping pattern.

I had found previously and described in a copending application that where a first plasma gun is employed to make a plasma spray deposit in an area and this deposit is normally porous and a second gun is employed to make a deposit in the same area, and this second deposit would normally be porous, that surprisingly a fully dense deposit can result. More surprising still I have now found that when a deposit of even small dimensions is formed on a surface of complex geometry, and part of the surface is at a non-normal angle to the first gun direction, the simultaneous use of a second gun and a second aim direction and the setting of the aim direction of the second gun at an acute angle to that of the first gun and preferably normal to another portion of complex surface, highly dense and surprisingly uniform low pressure plasma deposited coatings may be obtained.

Where coating of a still more irregular receiving surface is sought the use of more than two guns set at more than two different acute angles simultaneously is part of the method of the present invention.

BRIEF DESCRIPTION OF THE DRAWINGS

The description which follows will be understood more clearly if reference is made to the accompanying drawings in which.

DETAILED DESCRIPTION OF THE PRESENT INVENTION

Figure 1:
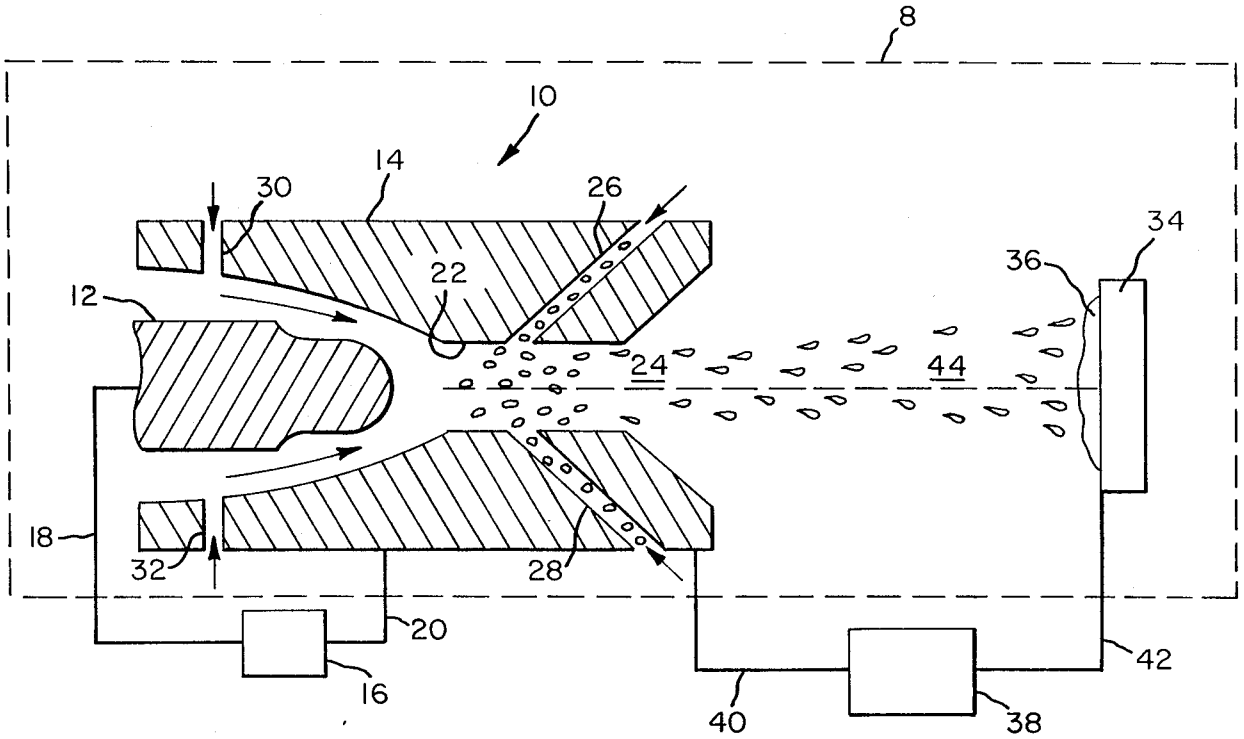
FIG. 1 is a schematic rendering of a low pressure plasma deposition apparatus with particular emphasis on the plasma gun and its relation to the target.

A plasma spray gun 10 enclosed within a low pressure enclosure 8 is shown schematically in FIG. 1. The gun has a central cathode 12 which is spaced from an annular anode 14. A working voltage is established between the anode and cathode by a power supply 16 connected respectively to the cathode and anode by conductors 18 and 20. The anode has a central aperture 22 through which a stream of particles shown schematically at 24 are passed. The particles are supplied to the aperture 22 through the supply ports 26 and 28 spaced around the anode 14. A flow of gas is introduced through the ports 30 and 32 and the gas passes through the annular space between cathode 12 and anode 14. The gas is introduced through port 30 and 32 from a source not shown and its flow through the annular space between the cathode and anode permits a plasma arc to be established based on the imposition of a suitable activating power and arc between the anode and cathode. The sweep of the gas through the annular clearance and through the orifice 24 carries the particles introduced into the orifice from the orifice and toward a target 34 spaced from the arc plasma spray gun 10. A deposit of material 36 is formed on the target 34 which serves as a substrate for the layer of deposited material 36.

The gun and target are enclosed within a low pressure enclosure 8 shown as a dashed line in FIG. 1. Appropriate gas and powder supply means supply the gun from reservoirs external to the enclosure 8.

A suitable power supply 38 is provided to maintain a desired voltage between gun 10 and target 34 and to impose on the target a desired change in voltage as may be suitable for operation of the gun and deposit of a desired layer 36. Conductors 40 and 42 connect the power source 38 to the gun 10 and target 34, respectively. While the plasma arc is established between the anode and cathode a very high temperature is generated of the order of 10,000° to 20,000° C. and the energy of this plasma is sufficient to cause a fusion of the particles introduced into orifice 24. The molten particles are carried on the plasma jet spray from the gun 10 to target 34 in the stream 44 as illustrated.

Where a deposit is made with the low pressure plasma technique using a plasma gun such as 10 onto a relatively large surface such as 34 the surface itself is preferably heated. The heating may be by means of the heat from the plasma gun itself or may be from an independent source. Where a single gun is employed of about 80 kilowatt plasma spray energy the maximum area of a sample which can be maintained at about 900° C. is about 1000 sq. cm. 1000 sq. cm. is contained within a generally circular area of about 36 centimeters diameter.

For example, where a sample ring having a 7.5 centimeter width and a 30 centimeter diameter was formed by deposit from a plasma gun onto a mandrel using a single plasma gun of about 80 kilowatt energy, the ring was apparently not sufficiently heated during the deposition and this was evidenced by distortion and high residual stresses after chemical removal of the mandrel.

Two EPI model 03-CA plasma spray guns with 03-CA-80 anodes were mounted side by side in a water cooled low pressure chamber which had dimensions of 114 centimeters in diameter and 137 centimeters in length. Within this structure a gun mounting bracket was disposed so that two guns could be mounted to the bracket as close as 9 centimeters apart and these two guns could be angled so that the aim point of each gun could be varied widely through a control mechanism actuatable from the exterior of the chamber.

The apparatus was also equipped to hold substrate mandrels measuring approximately 15.2 centimeters by 25.4 centimeters with a thickness of 0.32 centimeters. The mandrels used were planar copper sheet. After a deposition of a layer by the low pressure plasma method on the surface of the mandrel, the substrate mandrels were removed by selective chemical dissolution.

The powder which was used in plasma-forming these layers was a −400 mesh metal powder of alloy IN-100 obtained from Homogeneous Metals, Clayville, New York.

After removal of the mandrel the deposited layer was cut into conventional test dumbbell shapes as conventionally used in conducting tensile tests and having end pieces and a centerpiece of approximately 0.203 centimeters in width. Thickness was approximately 0.157±0.0025 centimeters.

Figure 2:
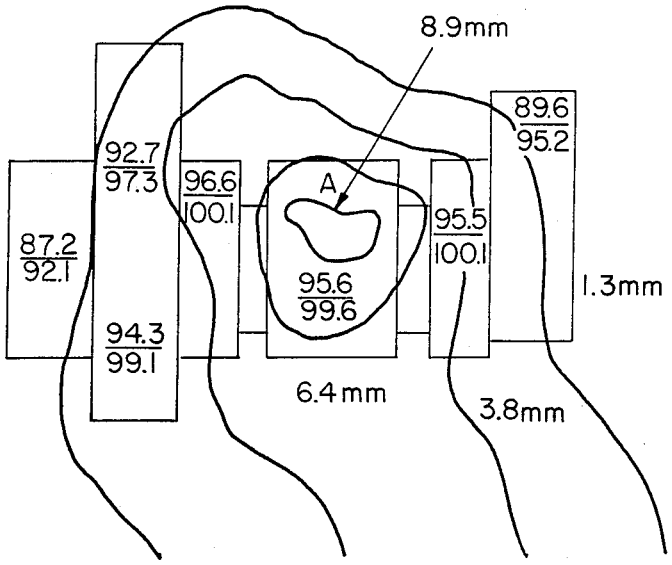
FIG. 2 is a contour map of a plasma spray deposit recording deposit thickness and the density at various locations.

Referring to FIG. 2 the results of forming a deposit on a receiving surface from a single plasma spray gun are illustrated. The contour lines illustrate the pattern of the deposit of even depth. From the legend of FIG. 2 the density figures for each sample of the deposit enclosed within the marked rectangle is evident. In the center the deposit density is 95.6 and this is raised to 99.6 by a 2 hour heat treatment at 1250° C.

However the density of the two outer rectangles is low both in the as deposited condition 87.2 and 89.6 respectively, and after anneal 92.1 and 95.2 respectively. Specimens with such low density are also found to have low tensile strengths.

Figure 8:
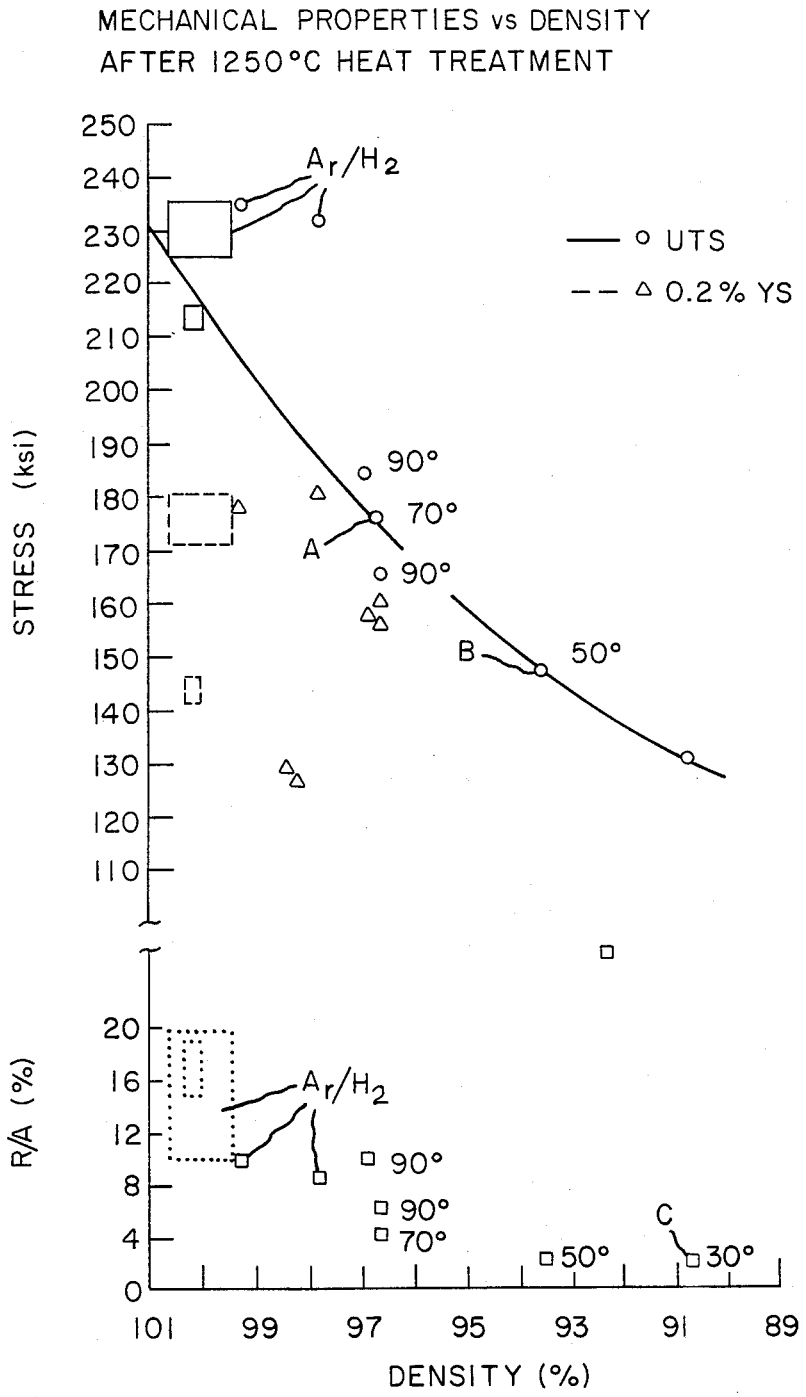
FIG. 8 is a set of two graphs the upper part of which is a plot of stress against density and the lower portion of which is a plot of the reduction in area of a tensile specimen against density and which relates to ductility or extensibility of the samples.

The significance of the different densities of material which is deposited by the rapid solidification plasma deposition as practiced according to this invention may be made clearer by reference to the data which is incorporated in FIG. 8. In the Figure the density achieved for samples deposited with a single gun poised at 30°, 50°, 70° and 90° is plotted. From the positions of the marked angles on FIG. 8 it can be seen that the density values achieved for particles which are plasma sprayed at low angles of 30° or 50° are quite low and are of the order of 90% and 93%.

In FIG. 8 the density is plotted as the abscissa with decreasing density from the ordinate line. The ordinate is plotted in two sections the lower of which is designated the ratio, given as a percentage figure of the original specimen diameter (R) to the final specimen diameter (A). For example, in the lower left hand corner of the Figure a data point appears at approximately 90% density and 9% reduction in area. The significance is that the sample corresponding to that data point has an area at the narrow point of the tensile test specimen which has been reduced by 9% of its original dimensions when the specimen was pulled into two segments.

The upper plot of FIG. 8 shows the strength in ksi of a specimen as the ordinate plotted against the percentage of density of the respective samples. The percentage density is on the same scale as is used in the lower portion of FIG. 8. For example, a round data point at 180 and 97% indicates an ultimate tensile strength (UTS) of about 180 ksi for a material having a density of about 97%.

A triangular data point located at the same position would show that a test specimen having a density of about 97% displayed a yield strength (YS) of approximately 180 ksi using the standard yield strength tests and indicators.

The box at the upper portion of the FIG. 8, shown in the solid line, is a region of numerous data points and the enclosure within the box is intended to signify that numerous data points were taken within the indicated range. The values shown are for the ultimate tensile strength of the material tested.

A corresponding box in dashed lines in the 170–180 ksi range represents numerous corresponding data points showing the yield strength of the materials tested. In other words for the materials which were tested and which have values of ultimate tensile strength (UTS) in the range of 230 ksi, these same samples had yield strengths in the range of 170 to 180 ksi.

Similarly the smaller rectangular box at about 213 ksi defines an area signifying multiple test points of the ultimate tensile strength (UTS) of various samples. The dashed box at about 145 ksi signifies the corresponding yield strengths (YS) of the same samples plotted in the solid box above at 213 ksi.

Further the data within the solid box at about 230 ksi were samples taken from the sweet spot of each sample tested. The sweet spot terminology as used herein means a dense region of a deposit of plasma sprayed material which is the result of a deposit from a stationary gun onto a stationary substrate with no relative motion therebetween. For example the data collected for the upper box of FIG. 8, particularly the solid line box at about 230 ksi, was a measurement made from a sweet spot sample and one which had been prepared using a mixture of argon and hydrogen in the gun from which the deposit was emitted. The hydrogen in this mixture was a relatively low percentage both based on volume and an even smaller percentage based on weight.

Some of the samples which were prepared were prepared with a single direction relative motion between the gun and the collector plate. For example, the data collected with regard to those data points which are included within the solid line box at about 214 ksi were prepared from a plasma between a gun and a collector plate where a motion in the x direction, or in other words a single and first direction, attended the deposit from the plasma onto the plate. For these samples the deposit formed was a deposit having outer dimensions of approximately 5 cm $\times$12 cm due to the relative motion of the gun and the collector plate.

Other samples were prepared while there was more complex relative motion between the gun and the collector plate. In a number of samples identified on the FIG. 8 the relative motion of gun and plate was a two directional motion. The two directions were at 90° to each other and the deposit formed was one having overall outer dimensions of approximately 15 cm$\times$15 cm.

Still other data points were made employing both a two directional relative motion between the gun and plate and in addition a deposition angle of the plasma directed toward the plate. The data point for example identified as A is a data point taken where the deposition angle was 70°. The data point B was a data point taken where the of deposition angle was 50° and the data point C represents a point at which the deposition angle was 30°. For other data points, where the deposition angle is not identified the deposition angle is 90°.

It is readily evident with relation to the data concerning the deposition angle that there is a rapid dropoff of the strength and density properties of the samples which are measured for samples prepared with progressively lower deposition angles of the aim point of the gun relative to the longitudinal axis of the gun from which the plasma originates.

With reference to the gases employed in the operation of the gun all samples were prepared using a mixture of argon and helium in the gun except where it is designated on the plot of FIG. 8 that the mixture of argon and hydrogen was used in the gun.

Turning now to the data plotted at the lower portion of FIG. 8 the samples which were prepared and from which the data was taken are the same samples as were prepared and tested in the upper portion of the figure. For example the data included within the solid line box at about 230 ksi is represented by plural data points included within the dotted box extending from about 10 to 20% (R/A). The other data points in the graph of the relationship between the percentage of ductility (approximately proportional to R/A) and the density plotted as abscissa are measurements made on the same samples which were prepared and tested and are included in the graph at the upper portion of FIG. 8.

When depositing superalloy powder by plasma technology, it is known that the best results of low pressure plasma deposition are achieved when the substrate to receive the deposit is heated to approximately 900° C. However, unless means are provided for maintaining the temperature of the receiving surface or receiving article at the preferred elevated temperature of about 900° C. the size of an article to receive a coating is limited where the only source of the heat is the heat from the plasma gun itself. Based on calculations an 80 kilowatt plasma gun can maintain a surface of about 1,000 sq. cm. heated to a temperature of about 900° C. For larger articles the article does not attain the preferred temperature and accordingly there is some danger of deficient properties in a deposit which is made because of the less than desirable temperature of the receiving surface.

However, in accordance with the present invention the formation of dense deposits on receiving surfaces of larger dimensions is feasible because of the use of multiple plasma guns to deposit a layer of material on the surface but also because the surface which is to receive the material is itself preferably heated to elevated temperatures which, as indicated above, should be of the order of at least 900° C.

EXAMPLE 1

A gun apparatus as described in reference to FIG. 1 above was employed in a chamber maintained at reduced pressure and the pattern of deposit of the layer of material from the gun was studied. Neither the gun nor the target were moved during the deposit of this Example.

The target used was a plate and the pattern of deposit of material on the plate was studied. The pattern is outlined in FIG. 2 for a first gun designated as gun A. The contour outlines of FIG. 2 are the zones in which different thicknesses of deposit were found of the sample deposit formed under the following conditions.

The powdered material used was an alloy identified as IN-100. The alloy contains the following ingredients in the following approximate concentrations: 60.5% nickel, 15% cobalt, 10.0% chromium, 5.5% aluminum, 4.7% titanium, 3.0% molybdenum, 0.06% zirconium, 1.0% vanadium, 0.014% boron, 0.18 carbon. The powder was −400 mesh IN-100 (less than 37 μm).

The voltage within the gun was 50 volts and the current was 1300 amperes. The gun was directed generally normal to the surface of the target and the separation of gun nozzle to target was $12\frac{1}{2}$ inches.

The pressure within the vacuum chamber was 60 Torr.

No voltage was impressed from the gun to the target as the transferred arc phenomena was not employed.

The plasma gun used was a commercially available gun sold under the designation EPI, Model 03CA by the Electro Plasma, Inc. of Irvine, Calif.

The target employed was a sheet of copper metal having dimensions of 6 inches × 8 inches × $\frac{1}{8}$ inch thick.

Following the plasma deposition the deposit was heated for 2 hours at 1250° C. to densify the deposited layer. Measurements were made of the density of the material both before and after the densification heating. The results of this study are illustrated in the FIG. 2.

In FIG. 2 the contour lines show the area of deposit at each thickness. The thicknesses are those marked in millimeters between the contour lines for each demarked area . The marked rectangular areas are those from which samples were taken for measurement. The fractional values listed for each rectangular area shows the density as deposited as the numerator of the fraction, and the density after densification heating for 2 hours at 1250° C. as the denominator of the fraction.

The values listed demonstrate that lower density deposits are produced at greater distances from the aim point, marked by the letter A at the appropriate aim point on the Figure.

This example teaches what is achieved by plasma spraying from a single gun aimed normal to a receiving plate. From this example it is clear that there is a serious problem of decreased density of deposit at distances from the aim point of the gun where the highest densities are achieved. Also it is clear that the low density deposits are not aided by the densification heat treatment.

EXAMPLE 2

A second gun, designated as gun B, and essentially as described in Example 1 was employed to deposit the same IN-100 material on a second target under essentially the same conditions as described in Example 1.

Figure 3:
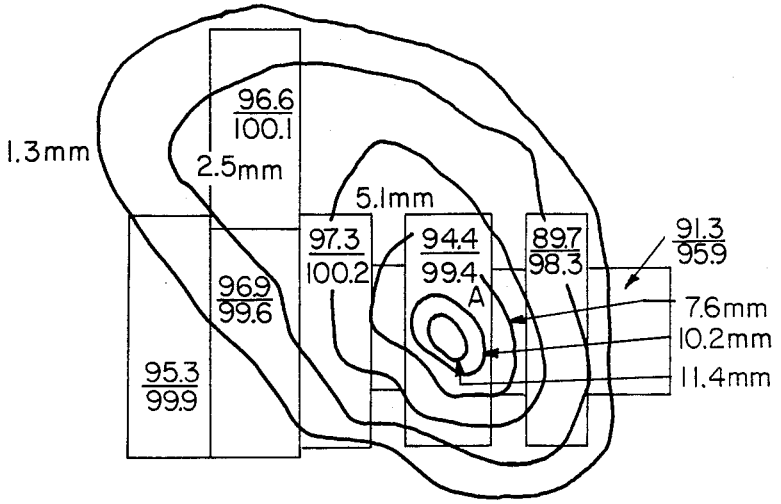
FIG. 3 is a contour map similar to that of FIG. 2.

The contour lines of the deposited material are illustrated in FIG. 3. The density values for the deposit both before and after densification heating are illustrated also on the figure in the form of fractions.

My past experience in use of guns as part of the low pressure plasma deposition of material indicates that no two EPI anodes are exactly alike and that the spray pattern from any one of them tends to change continuously during usage. This change is attributed partly to wear and erosion in the arc chamber and in the powder-feed ports and partly to individual operating characteristics of a gun. Accordingly the outer shape as well as the form of contour lines is different from one run to another even where the same gun and same target are employed.

EXAMPLE 3

Two guns, particularly the guns A and B as described with reference to Example 1 and Example 2 were both positioned in a low pressure plasma deposition chamber and were directed at a single target. The locations or aim points on the target where the gun was directed was separated by approximately 3.8 cm.

Figure 4:
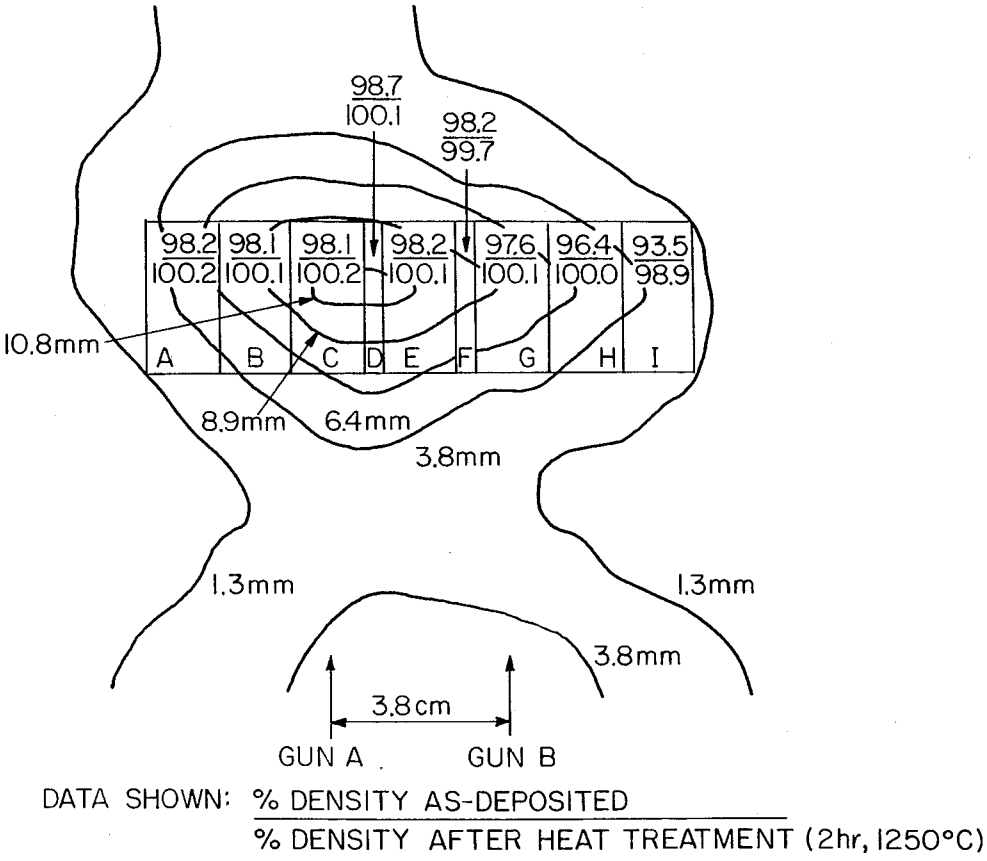
FIG. 4 is a contour map similar to that of FIG. 2 but one for a deposit made employing two guns.

The contour lines of the deposit made from the simultaneous spray with the two guns is illustrated in FIG. 4. The material deposited on the target in this Example was then heat treated for 2 hours at 1250° C. and was densified by the heating. The density of the deposit both before and after the densification heating is shown in the figure as well as shown in the earlier examples in the form of fraction values.

From the data plotted in FIG. 4 it is evident that as compared to the deposits of FIGS. 2 and 3 a substantial expanse of high density plasma spray deposit was formed by the method of this example employing the two guns aimed to deposit overlapping patterns of the sprayed product.

This result is highly unexpected because the area where high density deposit is formed is extensive and includes areas where two layers of low density material are deposited. What is surprising is that the two layers of low density deposit combine to form such an extensive combined layer and that the combined layers had high density in spite of the fact that the layers from which they were formed were low density.

EXAMPLE 4

The procedure employed in Example 3 was repeated but in this case the separation of the aim point of the two guns within the chamber was enlarged to 6.4 cm.

Figure 5:
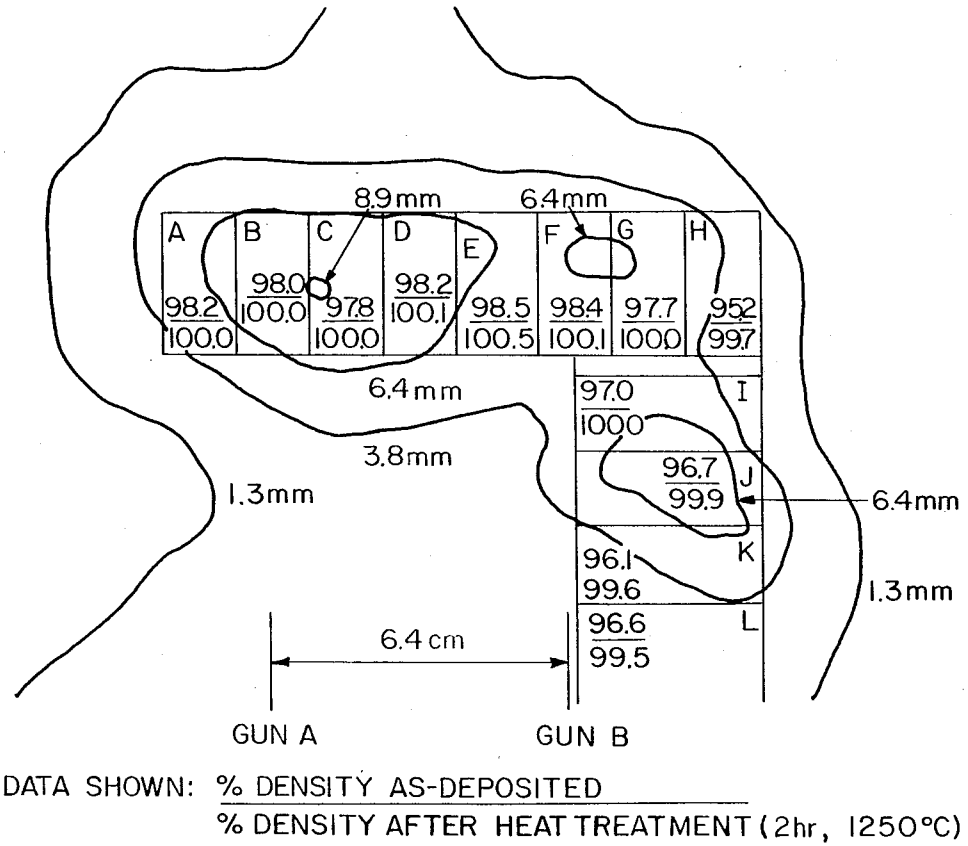
FIG. 5 is a contour map similar to that of FIG. 4.

The material was deposited and the contour lines of the deposit are illustrated in FIG. 5. Samples were taken from the deposit and the density was determined both before and after densification heating as described in Example 1. The values of density are marked in fractional form on the designated samples of the deposit as in Examples 1 and 2.

EXAMPLE 5

The procedure of Example 3 was repeated but in this case the aim point of the two guns was separated by 8.9 cm and the deposit of material was made as described above in Example 3.

Figure 6:
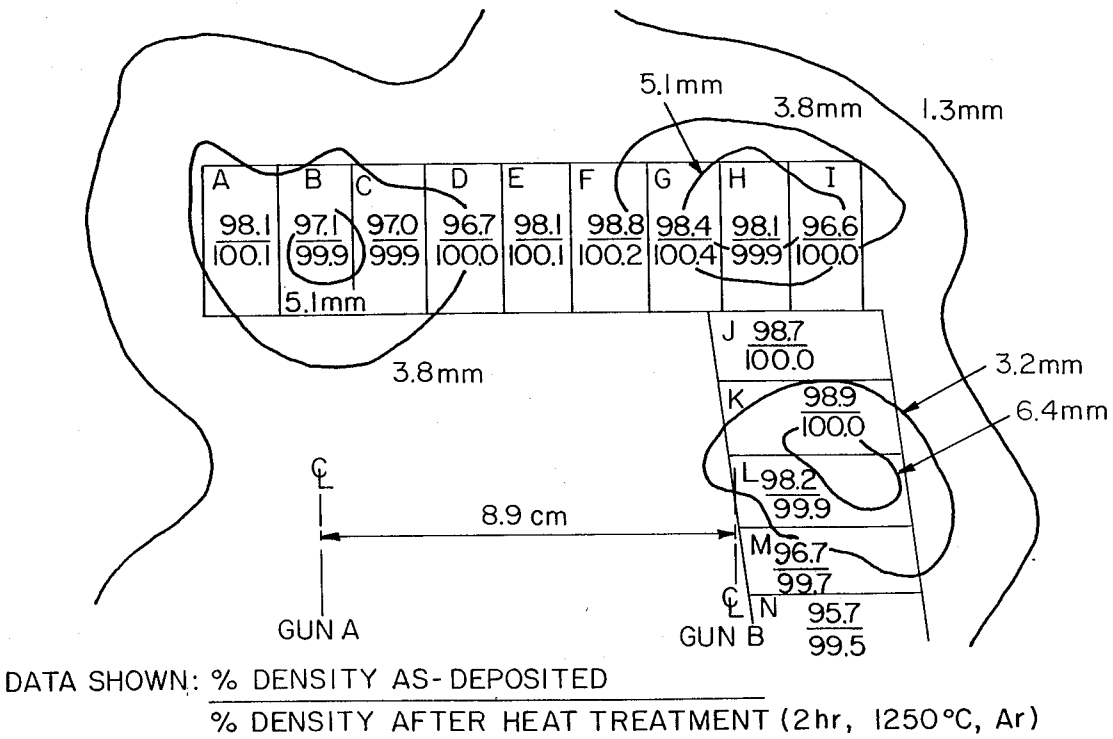
FIG. 6 is a contour map similar to that of FIG. 4.
Figure 7:
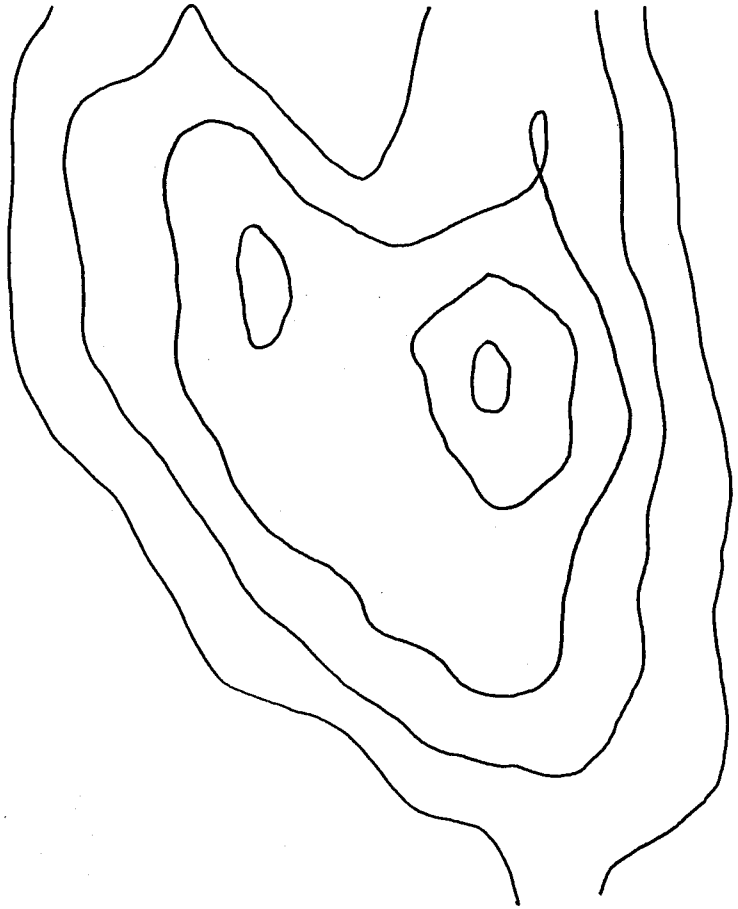
FIG. 7 is a map similar to that of FIG. 4.

A number of samples were taken from the deposit and the density of the samples both before and after densification heating was measured. The densification treatment was a two-hour treatment at 1250° C. as described in Example 1. The pattern of the deposits as indicated by contour lines is as shown in FIG. 6. Also, the density of the sample material taken from the deposit is shown in the respective areas of FIG. 6.

The results obtained from examination of the sample prepared in accordance with Example 5 revealed that the metallurgical structure of specimen cross-sections made from the target, and specifically from specimen E at the center of the target, where there was an overlap of the spray regions, produces evidence that there is a very close similarity of the metallurgical structure of the overlap region when compared to Specimens B and H of Example 5 which are located at the respective aim point regions on the target.

From an examination of the photomicrographs developed from the metallurgical microstructure of each of the specimens, the specimens are not distinguishable based on an examination of the photomicrographs because of the great similarity between them.

From the FIG. 2, it is evident that where an initial deposit of the material is made at a lower density of 92% that subsequent heating to consolidate a layer is not effective in achieving the desirable consolidation to the high density of 99 or 100%.

It should be realized that one of the advantages of the low pressure plasma deposition technique is that it permits formation of structures which have advantageous crystal and particulate properties. The heating of such materials for extended times and at very elevated temperatures can effectively diminish or destroy the beneficial crystal and related physical properties of the layer. Accordingly, attempts to consolidate the lower density portions of deposit by extended periods and higher temperature heating may cause a sacrifice in the properties of the layer not only in the less dense area but also in the fully dense portions which must be subjected to the same long-term higher temperature heating. It has been found that extensive heating of deposits that are less than 97% dense as-deposited will not result in full densification of these deposits.

From the above examples it is evident that a deterioration in properties accompanies the effort to apply a high density integral spray structure to a planar surface of larger dimensions than the area in which dense plasma spray deposits are formed and that the simple heating of the deposits does not cure the density deficiency. Further it is clear that the physical properties are related to density so that a lower density deposit also means a lower strength deposit. Further it has been shown that quite surprisingly this deficiency can be overcome by the employment of two or more guns which are operated so that the lower density deposit from one gun overlays the lower density deposit from a second gun. The very surprising element here is that the lower density deposit from each of the guns in some way consolidates into a high density deposit so that surface structures can be built which are not otherwise feasible.

Further the movement of a single gun to impart the high density spray to selected areas of a larger area surface does not overcome the low density deposit in the same fashion as the use of two guns. Accordingly efforts to spray larger areas on a planar surface employing a single gun and accompanying relative motion of the gun and receiving surface are not effective in accomplishing this desired result.

COMPLEX GEOMETRY PLASMA SPRAY

The foregoing concerns the formation of deposits on planar surfaces employing a single gun or multiple guns aimed generally normal to the surface. However, it has been found, as pointed out above and as pointed out herein, that where the angle between the gun axis and the receiving surface is less than about 70° there is a very marked decrease in the density of the deposits which are formed and there is a consequent degrading of the plasma spray deposits which are formed. The foregoing concerns the formation of the dense deposits on planar surfaces. Quite surprisingly, however, it has been found that beneficial results are obtained when the plasma spray technology is employed in connection with receiving surfaces of relatively complex geometry and configuration. Accordingly it has been found that for a single gun deposit properties are degraded for complex shaped bodies fabricated using deposition angles of less than about 70° .

By prior art practice complex shape bodies are fabricated or coated by use of intricate control of a gun orientation and the corresponding substrate orientation. Such motion is designed so that all of the surfaces are exposed at least for a short period to a gun aimed for near 90° deposition. However, in using such motions there is an averaging of high and low angle deposition which results in a compromise in the properties of the layer which is formed. Further the deposit of a layer of high density over a layer of low density does not cure the low density and accompanying inferior properties of the underlying layer so that the properties of the overall structure formed are compromised.

However, surprisingly it has been found that by the use of two guns and by the angling of these guns relative to the surfaces of the structure of complex geometry to be coated leads to formation of a high density deposit and more surprisingly still to one of uniform thickness.

The coating of surfaces of complex geometry by use of a single gun and a mechanism for varying the orientation of the gun relative to the complex surface has, as indicated above, been found to be deficient in forming either a surface of relatively uniform high density or a surface layer of relatively uniform thickness over the surface of the structure of complex geometry.

EXAMPLE 6

Figure 11:
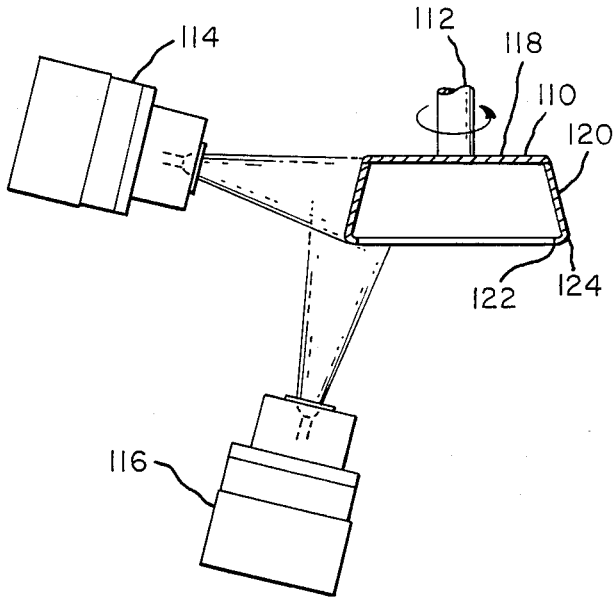
FIG. 11 is a semi-schematic view in part in section of a copper mandrel undergoing rotation about a vertical axis within a low pressure enclosure (not shown) and being subjected to the flames of two plasma guns.

A copper mandrel 110 is illustrated in FIG. 11 as mounted to a shaft 112 supported from a drive (not shown) which permits the shaft and mandrel to be rotated as indicated in the Figure. The mandrel and shaft were mounted in a low pressure plasma deposition chamber together with two plasma guns 114 and 116.

The mandrel 110 had a flat upper surface 118, a truncated conical or beveled side surface 120 and an inwardly extending lip 122. Between the outer wall 120 and the lip 122, a curved or rounded edge surface 124 is formed in the mandrel and is the characteristic shape of the article to be formed of the deposit being made on the mandrel. The article is a combustor for a jet engine and is about 6" in diameter. The combustor is formed by low pressure plasma deposition of a layer of IN-100. The IN-100 metal is supplied to the guns 114 and 116 in the form of a powder and is plasma sprayed by the action of the guns onto the external surface of the copper mandrel.

From observation of the structure of the copper mandrel 110 being plasma coated it is evident that the surfaces 120 and 122 and the curved portion 124 lying therebetween extend around a corner at an acute angle substantially greater than 20°. The angle is in fact probably closer to about 70°and is for this reason more difficult to coat than a right angle or in other words an angle of about 90°. The placement of the plasma guns 114 and 116 may be seen to be almost at right angles to each other. One gun 114 is aimed at the bevelled surface 120 at one side of the mandrel 110. The other gun 116 is aimed at the lip 122 and the corner rounded surface 124. Interestingly it was found that when one gun was employed in an effort to coat a mandrel with a uniform dense coating by relative motion of the single gun to present it first to the position 114 and then in the position 116 to the mandrel 110 that an uneven coating was formed and also that the uneven coating had dense and porous portions which made it useless as a combustor ring for a jet engine.

Two runs were made identified as 4-15-1S and 4-21-1S respectively. In the first run the two guns were each aimed at about 90° to the respective surfaces similarly to the representation of FIG. 11. In run 4-21-1S the guns were aimed at about 70° to each surface. It was found that in each of these runs very good density of deposit was formed. However, it was also observed that the run made at 70° and specifically that identified as 4-21-1S resulted in a more uniform deposit thickness and this was deemed to have resulted from the use of the 70° aim angle as opposed to the 90° angle of the 4-15-1S run. The data from these runs is set forth in the Table I below.

TABLE I

| Run # | Density As-Deposited | Density Heat Treated 2 Hours at 1250° C. |
|---|---|---|
| 4-15-1S | 97.2% | 97.8% |
| 4-21-1S | 100.0% | 101.0% |

EXAMPLE 8

Figure 10:
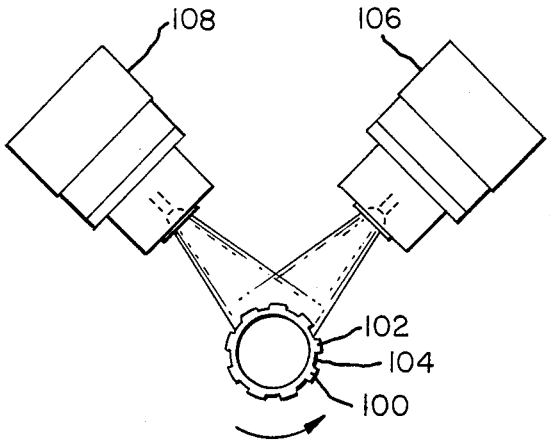
FIG. 10 is a semi-schematic axial view of an axially rotating mandrel for a gun barrel being plasma sprayed in a low pressure enclosure (not shown) by the flames of two plasma guns.

A simulated gun barrel was prepared from a mandrel as illustrated in FIG. 10. The mandrel 100 was formed by machining to have raised lands 102 and grooves corresponding to rifling grooves 104. Two plasma guns 106 and 108 were disposed in radial positions relative to the axis of the mandrel and were set at angles which were roughly at right angles to each other. The position of both guns was set to intersect with the top portion of the mandrel as it is illustrated in the figure. The mandrel itself was rotated in a counter clockwise direction as indicated by the arrow also in the FIG. 10.

Two runs were made employing two mandrels. The first run identified as 4-7-1S was made on a stainless steel mandrel with grooves machined along the length as indicated in FIG. 10 to simulate a gun barrel interior. A second run was made on a copper mandrel and was identified as 4-8-1S. In both runs the deposits were made using −400 mesh IN-100 powder. The density measurements were made and are listed in Table II.

TABLE II

| Run # | Density As-Deposited | Density Heat Treated 2 Hours at 1250° C. |
|---|---|---|
| 4-7-1S | 97.8% | 100.0% |
| 4-8-1S | 98.1% | 99.6% |

EXAMPLE 9

An effort was made to form a combustor ring as illustrated in FIG. 11 by use of a single gun. The gun was set at about 45° to the two surfaces 120 and 122. The alloy deposited was Reneé 80. The ring was rotated as the deposit was being made. The deposit made with the single gun at 45° as in this Example yielded a deposit having a density of 89.2% as deposited and this density was improved to 95.4% after heat treatment. However, a density of 95.4% is inferior as is indicated in the discussion above.

EXAMPLE 10

Another effort was made to form a ring as shown in FIG. 11 but in this case a sophisticated gun motion was employed to move the gun back and forth from a position of a 90% deposition angle on the wall to about a 45° deposition angle on the lip while the ring is being rotated about its axis. The alloy deposited was Co-29Cr-6Al-1Y. The ring deposited using this sophisticated gun motion was 92.2% dense as deposited and 98.9% dense after heat treatment for two hours at 1250° C. Here again it is evident that the use of a single gun and the complicated and sophisticated gun motion produces results which are inferior to those obtained through use of two guns as illustrated in FIG. 11 and as discussed above.

EXAMPLE 11

An effort was made to form a combustor ring having a diameter of 15.2 cm using −400 mesh IN-100 powder. Two guns were employed and were disposed as illustrated in FIG. 11. In this example the deposition was done using the guns aimed at 90° to each surface roughly as also illustrated in FIG. 11. The density of the deposit formed according to this example was 97.2% as deposited and 100.0% after heat treatment for two hours at 1250° C. The density of the deposit formed in this manner in the critical side to lip bend area is good. However, the uniformity of the thickness of the deposit was not as good as the density achieved.

EXAMPLE 12

A combustor ring with improved thickness and uniformity was fabricated. In this run deposition was made with guns positioned at about 70° to each surface. The guns were about 90° to each other as illustrated in FIG. 11 but were rotated about 20° clockwise to achieve the 70% orientation to each of the surfaces. The density of the deposit formed at the 70° deposition was 97.8% as deposited and a density of 100.1% was achieved after heat treatment for two hours at 1250° C. The metallurgical quality of the two gun deposited combustor rings was found to be highly desirable. This example illustrates the ability to control the quality, density and distribution of the deposit by means of gun placement and illustrates also that the method of the present invention is capable of fabricating complex shaped bodies.

Figure 9:
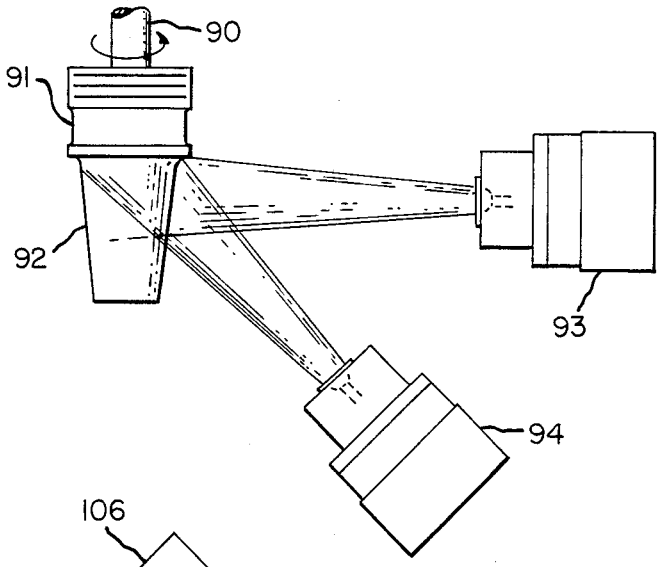
FIG. 9 is a semi-schematic elevational view of a turbine bucket blade rotating about a vertical axis and being sprayed in a low pressure enclosure (not shown) by the flames of two plasma guns.

One illustration of a complex shaped body is that shown in FIG. 9. It is a blade or a so-called bucket of a turbine. The turbine is supported from a shaft 90 and turned as indicated by the arrow going around the shaft. The bucket has a base portion 91 and a blade portion 92. Two guns 93 and 94 are disposed at an angle of about 45° to direct their respective flames at the blade portion 92 of the bucket. It has been found that by the use of two or three such guns directed at the blade portion of a turbine bucket that a relatively uniform dense layer can be formed on the surface thereof to achieve superior properties and performance in the bucket.

What is claimed is:

1. The method of forming a dense deposit over a receiving surface of complex geometry which comprises directing a first plasma gun at a first aim point on said receiving surface of complex geometry to deposit material processed through said first gun onto a first portion of said receiving suface, simultaneously directing a second plasma gun at a different aim point of said receiving surface to deposit like material processed through said second gun onto a second portion of said receiving surface.

the plasma flames from said two guns overlapping in a non-planar surface region between said aim points, the axes of said gun being at an angle to each other of greater than 20°, and said aim points being separated onto opposite or confronting surfaces of said complex geometry.

2. The method of claim 1 wherein the aim points are on opposite sides of an acute angle.

3. The method of claim 1 wherein the receiving surface is a turbine bucket.

4. The method of claim 1 wherein the receiving surface is contoured as an annular band and the aim points are at a side and bottom surface of said band.

5. The method of claim 1 wherein the receiving surface has corrugations and the guns are aimed at opposite sides of said corrugations.

6. The method of claim 1 wherein the receiving surface has sharp angular surface configurations and the guns are aimed at points on opposite sides of said surfaces.

* * * * *